United States Patent [19]

Stearns

[11] Patent Number: 4,715,187

[45] Date of Patent: Dec. 29, 1987

[54] CONTROLLED CRYOGENIC LIQUID DELIVERY

[75] Inventor: Thornton Stearns, Winchester, Mass.

[73] Assignee: Vacuum Barrier Corporation, Woburn, Mass.

[21] Appl. No.: 912,923

[22] Filed: Sep. 29, 1986

[51] Int. Cl.[4] ..... F17C 7/02

[52] U.S. Cl. ..... 62/55; 62/511; 62/514 R

[58] Field of Search ..... 62/55, 514 R, 511

[56] References Cited

U.S. PATENT DOCUMENTS

| | | | |
|---|---|---|---|
| 2,100,504 | 11/1937 | Crosley et al. | 62/511 |
| 2,676,470 | 4/1954 | Streitz | 62/511 |
| 3,025,680 | 3/1962 | De Brosse et al. | 62/514 R |
| 3,418,822 | 12/1968 | Massey | 62/55 |
| 3,433,028 | 3/1969 | Klee | 62/55 |
| 3,626,717 | 12/1971 | Lorch | 62/55 |
| 3,729,946 | 5/1973 | Massey | 62/55 |
| 3,972,202 | 8/1976 | Stearns | 62/514 R |
| 4,059,424 | 11/1977 | Bentz | 62/49 |
| 4,192,147 | 3/1980 | Gilbert | 62/49 |
| 4,356,700 | 11/1982 | Eckels et al. | 62/55 |
| 4,407,340 | 10/1983 | Jensen | 141/67 |
| 4,471,627 | 9/1984 | Hongo | 62/49 |
| 4,485,854 | 12/1984 | Roullet | 141/4 |
| 4,488,406 | 12/1984 | Eckels | 62/55 |
| 4,489,767 | 12/1984 | Yamada | 141/48 |
| 4,499,931 | 2/1985 | Urban | 141/67 |
| 4,546,609 | 10/1985 | Roullet | 62/49 |
| 4,561,258 | 12/1985 | Brodbeck | 62/49 |
| 4,583,346 | 4/1986 | Kameda | 53/431 |
| 4,612,773 | 9/1986 | Pelloux-Gervais | 62/50 |

FOREIGN PATENT DOCUMENTS

| | | |
|---|---|---|
| 1455652 | 11/1977 | United Kingdom . |
| 2091228 | 7/1982 | United Kingdom . |

*Primary Examiner*—Ronald C. Capossela

[57] ABSTRACT

A controlled stream of liquid cryogen is delivered from a system comprising: (a) a source of liquid cryogen at a substantially constant pressure, remote from the outlet; (b) a conduit connecting the liquid cryogen source to the outlet; (c) means to maintain cryogen flowing through the conduit sub-cooled at all points along the conduit (i.e., at any given point in the conduit, the cryogen's equilibrium vapor pressure is below the pressure experienced at that point in the conduit), and to deliver the cryogen to the outlet at a temperature equal to or below its boiling point at atmospheric pressure; and (d) a flow-rate control restriction, positioned in the conduit. By maintaining the cryogen sub-cooled, the flow is kept substantially (at least about 95% by volume) liquid. Therefore, the flow in the conduit is controlled reliably as to pressure, flow rate, and size. Specifically, the rate at which liquid cryogen is delivered at the outlet is controlled by the cross-sectional area of the flow-control restriction, and severe flashing at the outlet is avoided.

20 Claims, 6 Drawing Figures

FIG 5
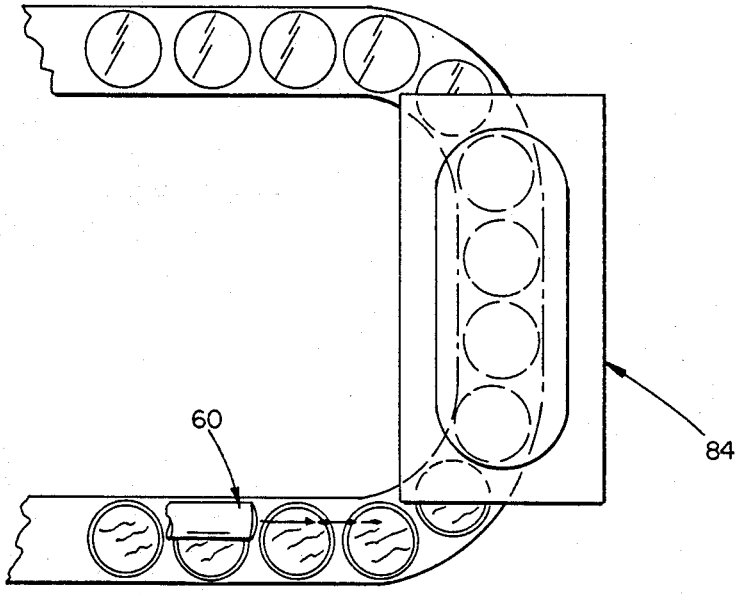
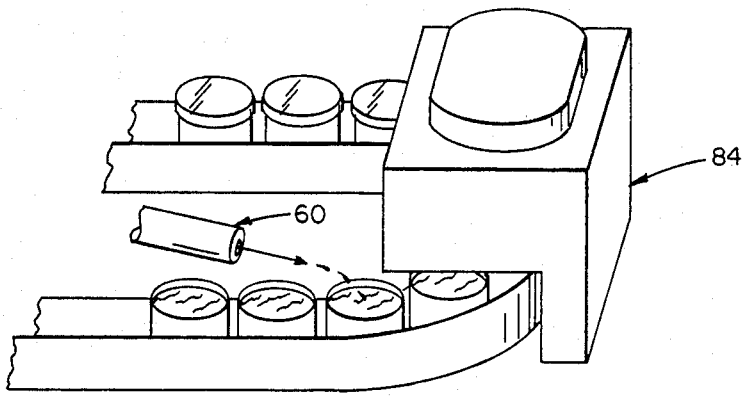
FIG 6

CONTROLLED CRYOGENIC LIQUID DELIVERY

BACKGROUND OF THE INVENTION

This invention relates to apparatus and methods for controlled delivery of cryogenic liquid, such as liquid nitrogen.

In various applications, it is important to deliver a metered amount of cryogenic liquid. For example, thin-wall containers, such as plastic, aluminum or steel beverage cans, can be used for non-carbonated beverages by adding a metered amount of inert cryogenic liquid immediately before capping the can. When vaporized, the inert cryogen increases internal can pressure which strengthens it, helping the can resist collapse, for example, when stacked for storage or for transport.

Controlled delivery is very important in such applications. Too little cryogen will not provide adequate pressure (strength), and the can may fail to withstand forces encountered in stacking and shipping. Too much nitrogen can create excessive internal can pressure, deforming the can and possibly exploding it.

The ability to meter cryogenic liquids is complicated by ambient water vapor which condenses and freezes on surfaces of the delivery apparatus, clogging it and contaminating the containers by dripping into them. In the environment of a production line, there may be extreme temperature and humidity conditions which exacerbate these problems. For example, an automated beverage can assembly line may involve injection of hot, recently pasteurized beverage into the can at a station adjacent to the apparatus for delivering liquid nitrogen. Large amounts of frost can build up on the delivery apparatus.

Another obstacle to metering the flow of liquid cryogen is the tendency of the cryogen to vaporize in delivery conduits, particularly when undergoing a pressure drop, e.g. at an outlet where liquid cryogen is supplied under pressure. Because of the large difference in liquid and vapor density, even a small amount of vaporization dramatically alters the volume ratio of liquid/vapor, thereby altering the rate of cryogen delivered over time.

The ability to meter cryogenic liquids is further complicated by splashing of the cryogen as the can moves along the assembly line rapidly, through sharp turns.

When the cryogen used is liquid nitrogen, which boils slightly below the boiling point of oxygen, another problem is oxygen condensation at the site of the cryogen, which can enrich the oxygen present in packaged food, having a detrimental effect on the food. The further the open container travels with liquid cryogen in it, the more serious this problem becomes, and cryogen delivery apparatus often is too bulky to be placed immediately adjacent the site where the cap is installed.

SUMMARY OF THE INVENTION

One aspect of the invention features apparatus for delivering a controlled stream of liquid cryogen from an outlet, which includes the following features: (a) a source of liquid cryogen at a substantially constant pressure, remote from the outlet; (b) a conduit connecting the liquid cryogen source to the outlet; (c) means to maintain cryogen flowing through the conduit sub-cooled at all points along the conduit (i.e., at any given point in the conduit, the cryogen's equilibrium vapor pressure is below the pressure experienced at that point in the conduit), and to deliver the cryogen to the outlet at a temperature equal to or below its boiling point at atmospheric pressure (e.g. cryogen is delivered to the outlet at a temperature within about 0.5° F. of its boiling point at the pressure surrounding the outlet); and (d) a flow-rate control restriction, positioned in the conduit. By maintaining the cryogen sub-cooled, the flow is kept substantially (at least about 95% by volume) liquid. Therefore, the flow in the conduit is controlled reliably as to pressure, flow rate, and size. Specifically, the rate at which liquid cryogen is delivered at the outlet is controlled by the cross-sectional area of the flow-control restriction, and severe flashing at the outlet is avoided.

One preferred feature of the apparatus for maintaining sub-cooled cryogen is insulation to control heat loss along the conduit. For example, the conduit is surrounded along substantially its entire length by a jacket adapted to contain liquid cryogen, which jacket in turn is surrounded by a vacuum chamber.

Another preferred feature is a heat-exchange bath to control the temperature of cryogen delivered to conduit. Specifically, the source of constant pressure liquid cryogen comprises a bath of liquid cryogen surrounding a tube supplying liquid cryogen to the conduit. The tube is positioned to be in heat exchanging contact with liquid cryogen contained in the bath. The pressure of cryogen in the bath may be maintained below the pressure at the delivery outlet to cool the liquid in the bath below its boiling point at atmospheric pressure. The tube in the bath is supplied liquid cryogen from a phase separator positioned above the bath to create a substantially constant pressure head. The bath is in communication with the liquid cryogen jacket surrounding the conduit, and cryogen is supplied from the bath to the jacket under a very small pressure head (e.g. 0.5-two inches) thus minimizing the cryogen temperature in the jacket.

Also, the liquid cryogen delivery apparatus preferably comprises a velocity-control chamber, which is elongated and generally horizontal to impart a direction and velocity to the liquid stream delivered from the system. The velocity-control chamber leads to a delivery outlet tube positioned to control the direction of the liquid cryogen stream delivered. At the end of the conduit having the delivery outlet, the vacuum chamber is surrounded by a dry gas jacket and a heater, to prevent condensation and oxygen enrichment at the delivery outlet. An adjustable preliminary restriction is provided upstream from the flow-rate control restriction to further control pressure head communicated to the flow-control restriction.

The system is well adapted for delivery of liquid nitrogen to pressurize containers moving along an assembly line toward a capping station. In that case, the cross-sectional area of the flow-rate control restriction is selected to deliver a desired amount of liquid cryogen to each container. A carefully controlled horizontal stream can be used to provide better control of the volume supplied to each can, and better control of the evaporation of cryogen from the can prior to capping and of splashing or sloshing. In particular, it is preferable that the velocity control chamber be generally horizontal and have a cross-sectional area selected to provide a liquid cryogen stream velocity and direction generally matching the velocity and direction of container movement.

Thus in a second aspect, the invention features a method of pressurizing containers comprising (a) moving the uncapped containers along a generally horizontal assembly line toward a capping station, the containers being upright and open at the top; and (b) generating a stream of cryogenic liquid having a controlled velocity, direction, and flow rate, the stream flow rate being selected to supply a desired quantity of liquid to each container immediately adjacent the capping station.

In preferred embodiments, the cryogen stream is generally horizontal to further reduce the distance between stream impact and the capper. In particular, the cryogen stream velocity and direction are selected to generally match the velocity and direction of the container movement, to reduce forces on the stream as it impacts the container contents. While the stream velocity and direction generally should match container movement, they need not be identical. For example, the stream velocity may be slightly less than the container velocity, so that the stream impacts the container contents with a force component that is opposite to the container movement, thus counteracting sloshing toward the direction of container movement. If the container assembly line is curved at the capper, the stream velocity direction and size are selected to impact the container off center, toward the inside of that curve, to avoid sloshing. The flow velocity and size may be selected to maintain an integral liquid stream at impact with the container contents. Alternatively, the stream velocity, volume and size may be selected to break into droplets before impacting the container contents, with at least three (preferably at least five) droplets impacting each container, so the variability resulting when a single droplet misses is reduced. Multiple nozzles may be used to provide smaller drops and thereby further increase the accuracy of the amount of cryogen delivered per container.

The method can be practiced using the above described delivery apparatus including a heating means positioned at the delivery outlet, which is activated while simultaneously delivering the stream of liquid cryogen.

Other features and advantages will be apparent from the following description of the preferred embodiment of the invention.

DESCRIPTION OF THE PREFERRED EMBODIMENTS

I will first briefly describe the drawings of preferred embodiments of the invention.

DRAWINGS

FIG. 5 is a highly diagrammatic top view of the nozzle of FIG. 3 operating to fill containers on an assembly line.

FIG. 6 is taken a side perspective of the assembly line and nozzle of FIG. 5.

APPARATUS

Figure 1:
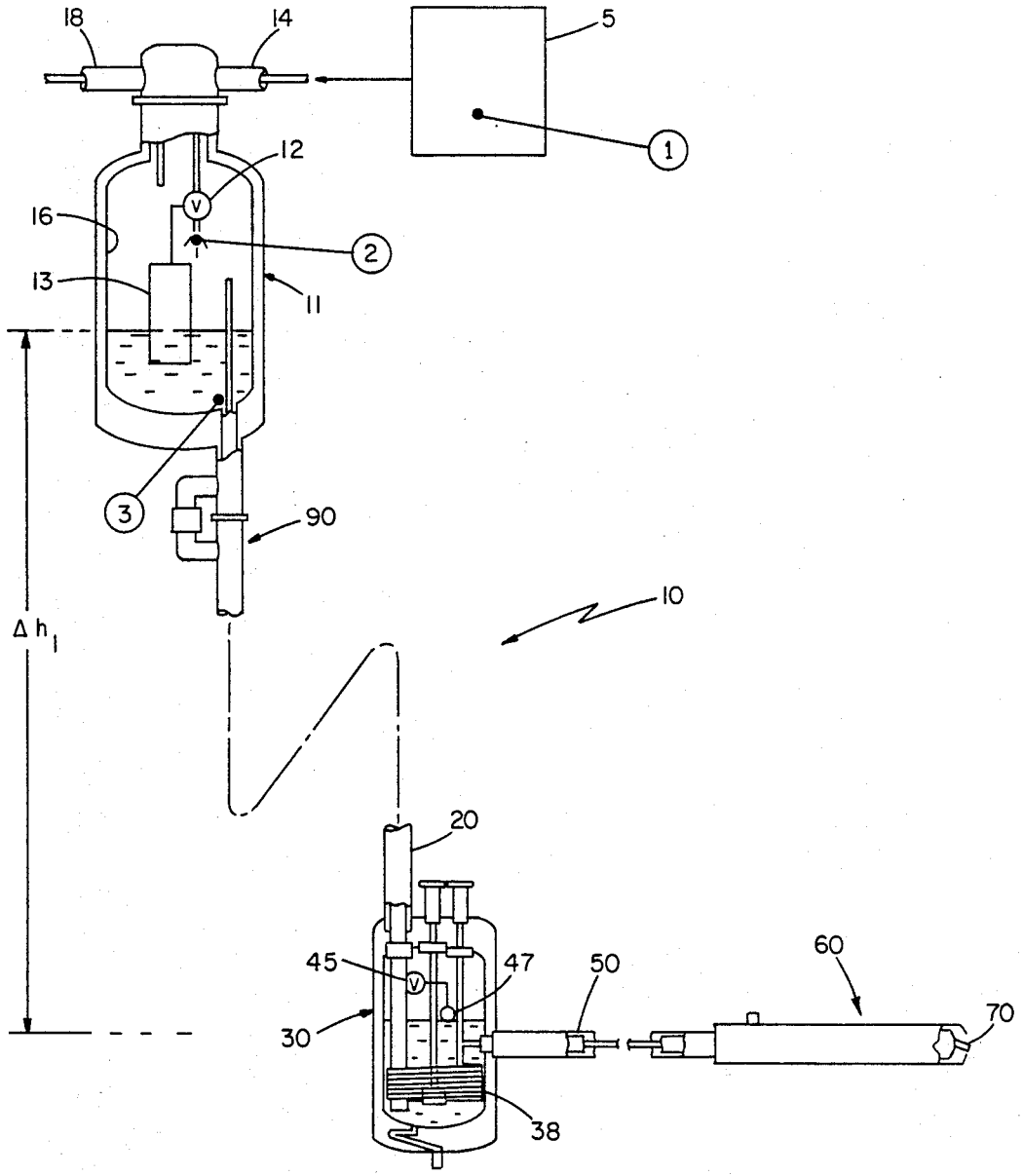
FIG. 1 is a diagrammatic representation of a cryogenic liquid delivery system.

FIG. 1 shows the three basic elements of the cryogenic liquid delivery system 10: a phase separator 11, a bath 30, and a nozzle 60. For convenience, the system will be described for use with liquid nitrogen, but it will be apparent that other cryogenic liquids could be used as well. Unless otherwise designated, the separator, bath and nozzle are welded stainless steel.

Figure 2:
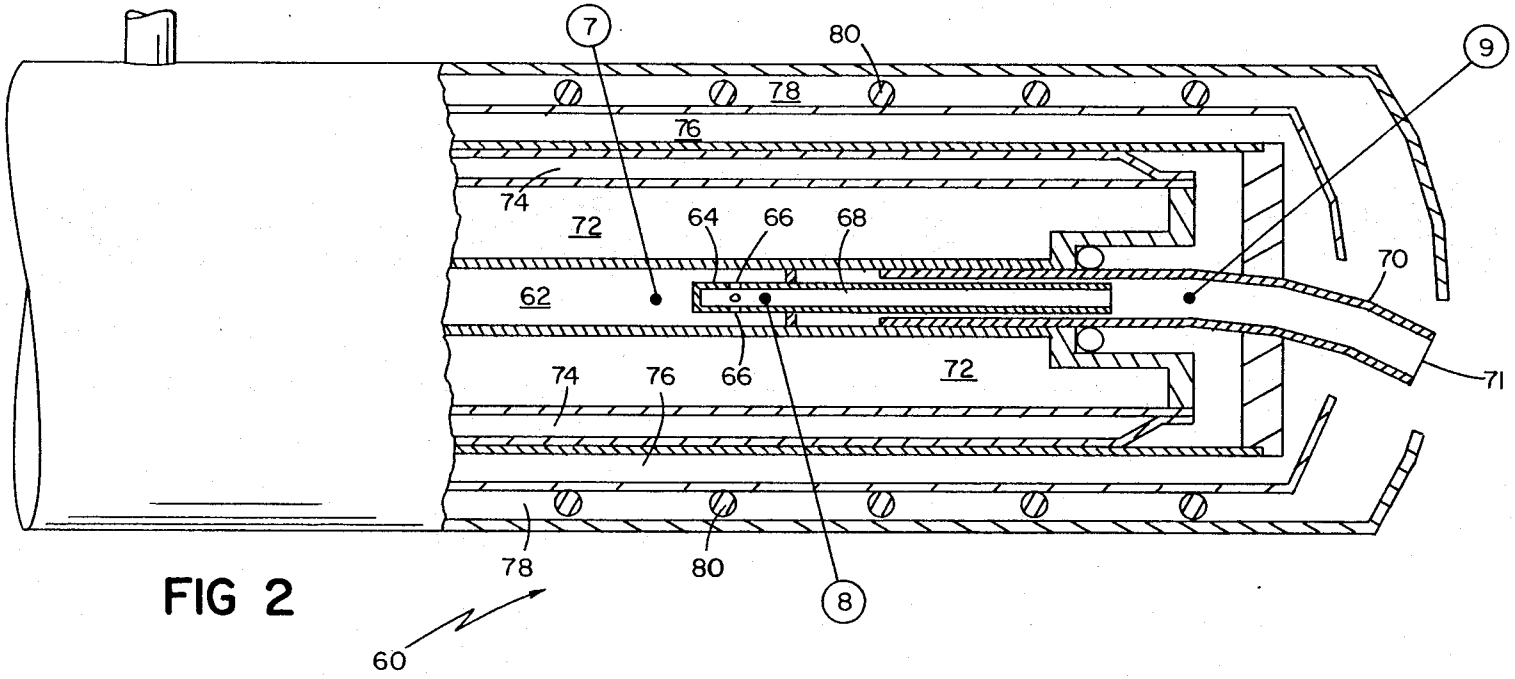
FIG. 2 is an enlarged side view of the nozzle of the delivery system shown in FIG. 1, with parts broken away and in section.

In FIG. 2, nozzle 60 has a central chamber 62, for carrying constant pressure, sub-cooled liquid nitrogen. Toward the tip of nozzle 60 is a flow-rate controller 64 having restricted radial orifices 66 leading from chamber 62 to velocity control chamber 68. Orifices 66 have a reduced cross-sectional area compared to chamber 62 and chamber 68, so they effectively control the flow rate from nozzle 60. Chamber 68 is designed to control the velocity of the flow received from orifices 66. At the tip of the nozzle, directional tube 70 surrounds chamber 68 and controls the direction of the stream of liquid nitrogen supplied from outlet 71. The diameter of tube 70 is larger than that of chamber 68 so that vaporization due to heat leak into tube 70 will not constrict significantly the cross-sectional area available for liquid flow.

Other features of nozzle 60 include a liquid nitrogen jacket 72, extending past the end of chamber 68, and a vacuum jacket 74. Surrounding jacket 74 is a jacket 76 of dry gas, and an outer jacket 78 containing heating coils 80.

Figure 3:
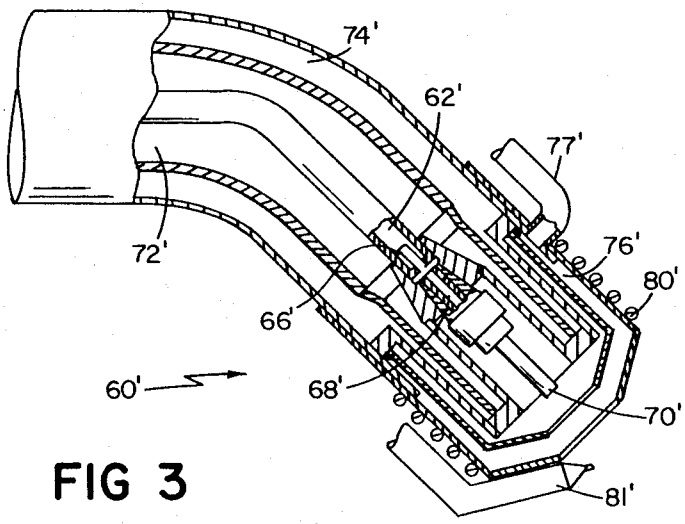
FIG. 3 is an enlarged side view of an alternative nozzle, with parts broken away and in section.

FIG. 3 shows an alternate nozzle 60' having a central chamber 62', jacketed by liquid nitrogen jacket 72' and vacuum jacket 74'. The flow-rate controller is positioned behind nozzle chamber 68', which is threaded into the head of nozzle 60'. A dry nitrogen gas jacket 76' is supplied by inlet 77'. Heating coils 80' surround jacket 76'. A jet 81' is positioned adjacent to the outlet to divert the stream of nitrogen quickly when the assembly line is temporarily stopped. Other features of nozzle 60', such as the radial orifices 66' in the flow rate controller and the directional tube 70', generally correspond to the features of nozzle 60.

Constant pressure sub-cooled liquid nitrogen is supplied to nozzle 60 (or nozzle 60') from phase separator 11 via bath/heat exchanger 30. Specifically, in FIG. 1, liquid nitrogen is contained in vessel 16 of separator 11, which is generally of the design described in my commonly owned U.S. Pat. No. 3,972,202, hereby incorporated by reference. An automatically controlled valve 12 controls the supply of liquid nitrogen from an external pressurized storage tank 5 through conduit 14 by means of liquid level sensor 13. Other sensors, such as a pair of electronic level limit sensors could be used. The upper portion of vessel 16 is vented to the atmosphere via vent 18.

Conduit 90 is a triax conduit; i.e., it has three concentric chambers. The interior chamber delivers liquid nitrogen from the bottom of vessel 16 to bath 30, under the force of the pressure head $\Delta h_1$ between the liquid levels in vessel 16 and bath 30. Conduit 90 has an inner return conduit coaxially surrounding the interior delivery chamber to carry return flow of a mixture of nitrogen vapor and liquid from bath 30, and an outer vacuum jacket, communicating with the vacuum jacket surrounding vessel 16. Conduit 90 can be purchased under the name Semiflex ® Triax from Vacuum Barrier Corporation in Woburn, Mass.

Conduit 90 is connected to bath 30 via a bayonet connector 20 (FIG. 4) which comprises a central conduit 22 connected to the delivery chamber of conduit 90, a return conduit 24 connected to the return conduit of Triax conduit 20, and a vacuum jacket 26, surrounding the return conduit.

Figure 4:
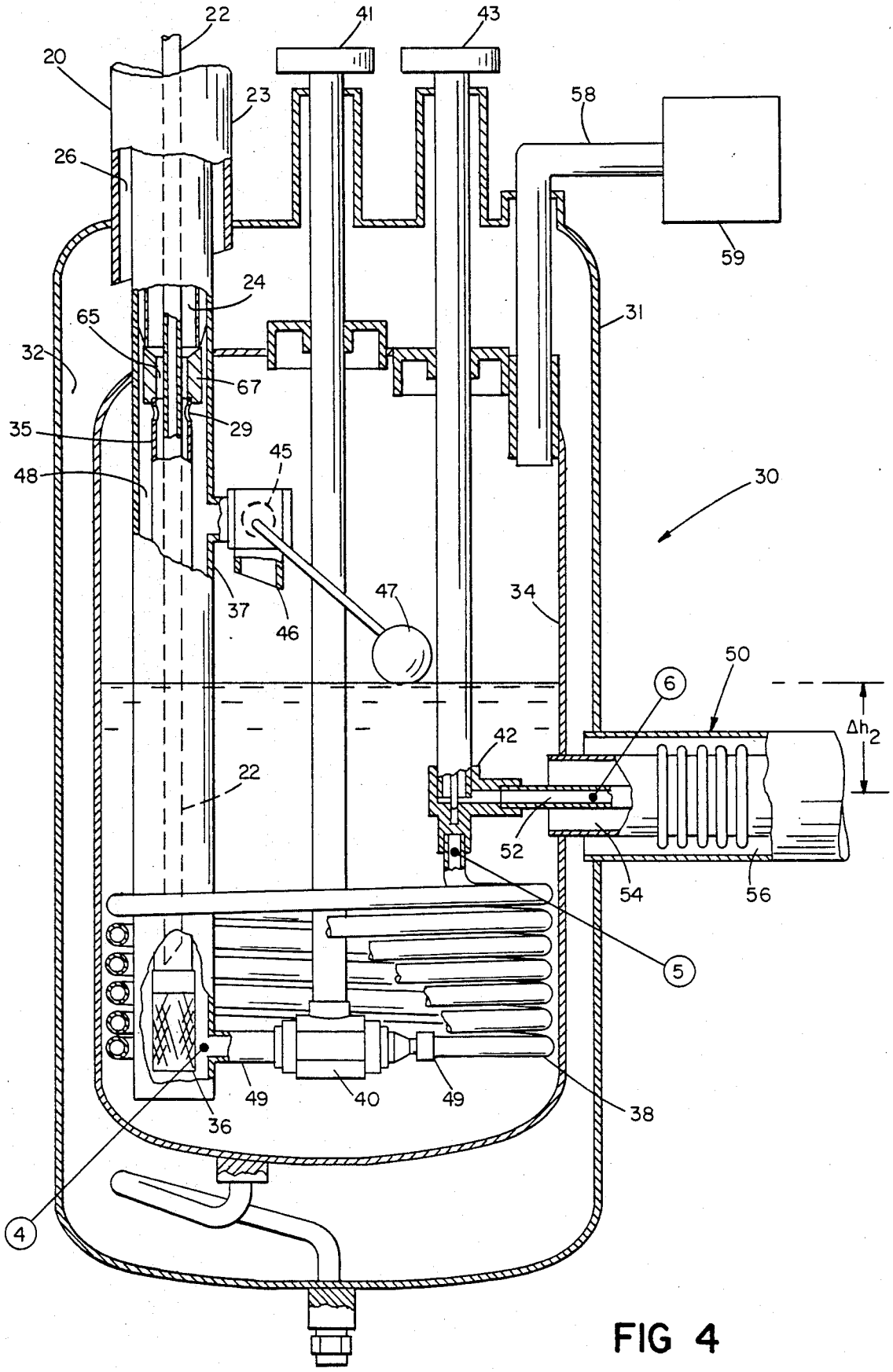
FIG. 4 is an enlarged somewhat diagrammatic side view of the bath of the delivery system shown in FIG. 1, with parts broken away and in section.

In FIG. 4, bath 30 has an inner chamber wall 34 surrounded by an outer wall 31 forming a vacuum space or jacket 32. Outer wall 23 of connector 20 extends through wall 31, so that vacuum jackets 26 and 32 are connected. The centeral interior conduit 22 of connector 20 extends into inner chamber wall 34 to its termination within a shield tube 35 surrounding conduit 22. A filter 36 is provided at the bottom of tube 35. An outer tube 37 surrounding tube 35 is fixed to inner chamber wall 34. An orifice block 37 supports tube 35 and forms the connection to connector 20. Radial openings 29 in the top of tube 35 allow circulation from the space 48 between tube 35 and 37, through a gap 65 between conduit 22 and block 67, to return conduit 24. To facilitate cleaning of filter 36, the assembly consisting of conduit 22, tube 35 and filter 36 can be removed from bath 30, leaving outer tube 37 which is welded to wall 34.

Liquid cryogen flowing out of chamber 22 passes through filter 36 at the bottom of tube 35, and enters the space 48 located between tubes 35 and 37. At the bottom of tube 37, pipe 49 connects space 48 to coil 38. Pipe 49 contains a shut-off valve 40 which is externally controlled by control 41. Toward the top of space 48, a fill-pipe 46 taps off of the space 48. Pipe 46 contains modulating valve 45, controlled by float 47, to provide a pre-determined bath level of liquid nitrogen in chamber 34. An externally controlled shut off valve (not shown) may be included in pipe 49 to stop flow when the container capping assembly line is stopped for a substantial period, thus avoiding waste of liquid nitrogen, while at the same time maintaining the delivery system in a state that allows relatively quick recovery when the line re-starts. Vent 58 can be a vent to the atmosphere, or, to increase cooling, it can be connected to vacuum pump 59.

Coil 38 is subsmerged in the liquid nitrogen bath. The downstream end of coil 38 is connected to a needle valve 42 which is externally adjusted by control 43. Downstream of needle valve 42 is conduit 50 supplying liquid cryogen to nozzle 60. Conduit 50 has a central chamber 52 surrounded by an inner jacket 54 of liquid nitrogen (from bath 30) and an outer vacuum jacket 56. Chamber 52 connects to central chamber 62 of nozzle 60, jacket 54 connects to jacket 72 and jacket 56 connects to jacket 74. Conduit 50 is positioned a pre-determined distance $\Delta h_2$ below the liquid level of bath 30, as described below.

OPERATION

The operation of the apparatus described above is as follows.

Liquid nitrogen is maintained at a preselected level in separator 11 by supply valve 12. Supply valve 12 could be replaced with liquid level limit sensors that operate a solenoid-controlled valve. In that case, the sensor set points would be set about 4 inches apart, operating with a precision of $\pm 0.5''$. The liquid nitrogen in separator 11 is at equilibrium with atmospheric vapor pressure, so its temperature is maintained at the boiling point of liquid nitrogen at atmospheric pressure.

The liquid nitrogen in separator 11 flows, driven by the pressure head $\Delta h_1$, through chamber 22 and into space 48. Liquid nitrogen in space 48 flows through fill pipe 46 to fill chamber 34 up to a desired level, modulated by valve 45 and float 47. Valve 12 is responsive to liquid level sensor 13 to maintain a designated liquid level in the phase separator.

In bath 30, the liquid nitrogen flows from conduit 22 to interior tube 35, and through filter 36 to tube 37. Initially, shut-off valve 40 is closed, so the liquid fills space 48 and flows through fill pipe 46, filling the bath until valve 45 is activated by float 47. Liquid and vapor returns through radial openings 29 to communicate with jacket 24 of conduit 20 and return a mixture of liquid and gas to the phase separator.

When valve 40 is opened, liquid nitrogen flows through heat exchange coil 38 and is cooled by liquid nitrogen in the bath. The liquid nitrogen then flows through needle valve 42 to the central chamber 52 of conduit 50. Because the pressure head $\Delta h_1$ is maintained at a constant level, the pressure provided to needle valve 42 is kept constant, and needle valve 42 provides additional pressure control. Specifically, needle valve 42 provides liquid to central chamber 52 and to nozzle 60 at a constant controlled pressure of about 1.0–1.5 psi, compared to the 3.0–3.5 psi of pressure head $\Delta h_1$. The resulting pressure of 1.0–1.5 psi at the delivery outlet is generally appropriate to provide the desired velocity and direction for one particular container capping line. As shown below, however, one skilled in the field would be able to use the invention in other capping lines simply by controlling cryogen pressure and volume to deliver the desired amount for other container sizes, speeds, etc.

Finally, it is important to keep the temperature of cryogen at the outlet substantially equal to or below its boiling point at atmospheric pressure (i.e. the pressure at the exterior of the outlet). Failure to do so could result in flashing (rapid vaporization) as the flowing cryogen experiences atmospheric pressure, making it difficult to control the amount of cryogen actually delivered to the container.

From the above, it can be seen that a constant-pressure source is one important aspect of controlling the flow rate and other characteristics of the cryogen stream delivered. Another important aspect of controlled delivery is sub-cooling throughout the delivery conduit system because vaporization in the conduit would make it extremely difficult to control cryogen delivery, even if the cryogen were supplied to the conduit at constant pressure. Specifically, at the point of vaporization, flow (in weight per unit time) would be radically changed, thus changing the amount of cryogen delivered to each container. Vaporization is avoided because, at any given point in the conduit, the cryogen is maintained at a temperature low enough to maintain its equilibrium vapor pressure below the pressure it experienced at that point. Therefore, the flow regime is substantially (at least 90–95% by volume) liquid.

The two goals specified above are achieved in the specific embodiment. As described above, a substantially constant pressure cryogen supply is achieved by maintaining a fixed pressure head $\Delta h_1$ that is relatively large (at least about one order of magnitude and preferably more) compared to fluxations in the pressure head during operation. The specific embodiment achieves sub-cooling by using the bath to cool cryogen delivered to the nozzle, and to supply coolant to the nozzle jacket. If vent 58 is connected to atmosphere, the bath temperature will be the cryogen's boiling point at atmospheric pressure, so cryogen supplied to the nozzle is sub-cooled relative to its pressured condition in the nozzle. Moreover, cryogen in the nozzle is maintained substantially equal to (within 0.5° F.) its boiling point at atmospheric pressure by the liquid cryogen jacket that taps off of the bath. In this way rapid evaporation (flashing) at the orifice is controlled. The point at which that tap is located relative to the bath level ($\Delta h_2$) is important in this respect. If $\Delta h_2$ is too high, the pressure head $\Delta h_2$ increases the temperature of cryogen in the jacket, and thus it increases the temperature of cryogen in the nozzle. If $\Delta h_2$ is too low, there may be inadequate mixing of cryogen in the jacket or, worse, loss of liquid altogether in the jacket. I have found that $\Delta h_2$ can be between about 0.5 and 2.0 inches. Thus, the double jacketing of conduit 50 and nozzle 60 maintains the sub-cooled state as the nitrogen flows through flow-control restriction orifices 66 into velocity control chamber 68. The bath is also important to control heat loss from the control valves.

In sum, because the flow in the nozzle is substantially liquid flow, it is possible to maintain flow and velocity control according to known principles of fluid dynamics and to avoid the unstable flow regimes that prevent control of the stream delivered. Specifically, the size of orifices 66 determines the overall flow rate and the diameter of chamber 68 determines the velocity of the flow. The directional tube 70 is designed to direct the stream of liquid nitrogen.

The sub-cooling effect is demonstrated by the example provided by Table 1. Those in the field will appreciate that the specific figures given in the Table are exemplary and do not limit the invention. The circled single digit numbers in the Figs. refer to the correspondingly numbered points in the Table.

TABLE 1

LIQUID NITROGEN DELIVERY SYSTEM

| Point No. | Location | Pressure (psi) | Saturation Temp. (°Rankine) | Actual Temp. (°R) | Source of Sub-cooling | Amount of sub-cooling °R | % Liquid (By Vol.) |
|---|---|---|---|---|---|---|---|
| 1 | Main storage Tank | 44.7 | 159 | 159 | None | 0 | 100 |
| 2 | Downstream of Separator Valve | 14.7 | 139.3 | 139.3 | * | 0 | 4.1 (vapor is removed via vent) |
| 3 | Separator Outlet | 15.05 | 139.65 | 139.3 | Turbulent Mixing | 0.35 | 100 |
| 4 | Conduit Inlet | 18.2 | 142.65 | 139.7 | Triax Return Stream | 2.95 | 100 |
| 5 | Control valve Inlet | 18.2 | 142.65 | 139.3 | Bath-Turb. Mixing | 3.35 | 100 |
| 6 | Control valve Outlet | 15.7 | 140.3 | 139.3 | Bath-Turb. Mixing | 1.00 | 100 |
| 7 | Upstream of Control Orifice | 15.7 | 140.3 | 139.344 | Bath + 1.5" LN2 Head | 0.956 | 100 |
| 8 | Downstream of Control Orifice | 14.875 | 139.475 | 139.344 | Bath + 7.5" LN2 Head | 0.131 | 100 |
| 9 | Outlet of Velocity Tube | 14.7 | 139.3 | 139.3 | * | 0 | 95.4 |

*Points 2 and 9 are cooled when liquid nitrogen evaporates rapidly due to a pressure drop.

FIGS. 6 and 7 are highly diagrammatic representations of nozzle 60 delivering a stream of liquid nitrogen to containers 82 on an assembly line. Downstream from nozzle 60 is a capper 84 which seals the containers.

As shown in FIGS. 5 and 6, nozzle 60 is positioned so that it provides a generally horizontal stream of liquid nitrogen. Depending on the exact configuration of the assembly line and the nozzle, the nozzle may be angled very slightly (e.g., 5°–15°) below horizontal. By generally matching the velocity of the nitrogen stream to the container velocity, the horizontal force component of the collision between the stream and the container is substantially reduced. Moreover, the pressure provided at the delivery outlet is dissipated into horizontal motion, not vertical motion. Thus, the stream impacts the container contents with a force determined primarily by the vertical drop between the nozzle outlet and the container.

Because the point of cryogen impact with the container is immediately adjacent the capper, evaporation and sloshing are controlled. In this context, the precise distance between the point of impact and the capper will depend upon factors such as the speed of the container line and the environment of the line. In any event, the distance will be small enough to avoid evaporation that would introduce uncontrollable variation in cryogen pressure in the capped container.

Because the system delivers precisely a metered amount of liquid cryogen at a precise pressure, it is practical to use known fluid-flow principles to estimate the quantity of nitrogen desired in each can and the variability resulting from a missed drop or from nitrogen loss between impact and capping.

For example, stream size and position can be controlled so that the stream breaks up into droplets before impact with the container, and the droplet size is well below the amount of nitrogen required per container. Preferably, the stream should be designed to produce at least 3–5 (most preferably at least 5–10) droplets per container, so that the variability introduced if one droplet fails to enter a container is better controlled. Alternatively the cryogen may be delivered as a steady unbroken stream at its point of impact with the container.

OTHER EMBODIMENTS

Other embodiments are within the following claims.

The flow control orifice may be a sharp edged, essentially planar orifice, or it may be an integral part of the velocity-control chamber. For example, the velocity control chamber may gradually increase in diameter from the restricted flow-control. While the use of a horizontal stream provides substantial advantages in reducing the horizontal velocity component at impact and in reducing the distance between impact and capping, other stream orientations are possible which benefit from a remote nozzle and controlled delivery. For example, where the container has a narrow opening, or where the assembly line movement is intermittent, it may be desirable to deliver a downward stream into a collection device positioned to collect the liquid and periodically deliver the nitrogen to containers. In this way, delivery pressure is dissipated by the collection device. A diverter such as gas jet 81' (FIG. 3) could also be used to divert cryogen flow between containers on a line that has intermittent movement, in which case the controller for the jet would be indexed and timed to the container line, by electrical connection to a container sensor or to a controller for the container line. It is also possible to include multiple outlet orifices in the nozzle, e.g. arranged circuferentially around the center of the nozzle axis, so that the drops delivered to the container are smaller, providing better control over the amount of liquid nitrogen delivered. Alternatively, the flow control orifice may be at the end of the conduit, and it may be adjustable, thus avoiding the need for the above-described needle valve in the bath.

I claim:

1. System for delivering a controlled stream of liquid cryogen from an outlet, the system comprising:

(a) a source of liquid cryogen at substantially constant pressure, remote from the outlet;

(b) a conduit connecting the source of liquid cryogen to the outlet;

(c) a flow-rate control restriction positioned in the conduit; and (d) means to maintain cryogen substantially entirely in liquid phase as it flows through the conduit, and out of the outlet, and to maintain said flowing cryogen at a temperature substantially equal to or below the cryogen's boiling point at atmospheric pressure;

whereby the cross-sectional area of the restriction controls the rate of liquid cryogen delivered at the outlet, and cryogen is reliably delivered at the outlet without severe flashing.

2. The system of claim 1 wherein the system comprises a velocity-control chamber downstream from the flow-rate control restriction, the chamber having a cross-sectional area larger than said restriction which is selected to control the velocity of the liquid cryogen stream delivered at the outlet.

3. The system of claim 2 wherein the velocity-control chamber is elongated to impart a direction to the stream delivered from the delivery outlet.

4. The system of claim 3 wherein the velocity-control chamber is generally horizontal.

5. The system of claim 1 wherein the conduit comprises insulating means to prevent heat leak substantially along its length.

6. The system of claim 5 wherein the conduit is jacketed by a chamber adapted to contain liquid cryogen.

7. The system of claim 6 wherein the liquid cryogen jacket chamber is surrounded by a vacuum chamber along substantially the entire length of the conduit, and, at the end of the conduit having the delivery outlet, the vacuum chamber is surrounded by a dry gas jacket and a heater, to prevent condensation and oxygen enrichment at the delivery outlet.

8. The system of claim 1 wherein the source of constant pressure liquid cryogen comprises a bath of liquid cryogen, surrounding a tube supplying liquid cryogen to the conduit, the tube being positioned to be in heat exchanging contact with liquid cryogen contained in the bath.

9. The system of claim 8 wherein the conduit jacket insulated along its length by a jacket adapted to contain liquid cryogen, and the jacket is in communication with the bath.

10. The system of claim 8 wherein the pressure of cryogen in the bath is maintained below the atmospheric pressure at the delivery outlet.

11. The system of claim 8 wherein the tube in the bath is supplied liquid cryogen from a phase separator positioned above the bath to establish an accurately controlled pressure head.

12. The system of claim 11 wherein a preliminary restriction is provided upstream from the flow-rate control restriction, so that the entire pressure head is not communicated to the flow-control restriction.

13. The system of claim 12 wherein the preliminary restriction is an externally adjustable needle valve.

14. The system of claim 1 further characterized in that the system is adapted for delivery of liquid cryogen to pressurized containers moving along an assembly line toward a capping station, the cross-sectional area of the flow-rate control restriction being selected to deliver a desired amount of liquid cryogen to each container.

15. The system of claim 14 wherein the system comprises a velocity-control chamber downstream from the flow-control restriction, the velocity control chamber being generally horizontal and having a cross-sectional area selected to provide a liquid cryogen stream velocity and direction generally matching the velocity and direction of container movement.

16. The system of claim 1 comprising a source of flowing liquid cryogen cooled to a temperature substantially equal to or below the cryogen's boiling point at atmospheric pressure, and means to split said source of flowing cryogen into at least two flow paths, the first of said flow paths comprising said delivery conduit communicating with said outlet and comprising means to maintain liquid cryogen in said delivery conduit above atmospheric pressure to support cryogen flow to said outlet, and the second of said flow paths being a jacket concentrically positioned around said first flow path, said means to split said source of flowing cryogen comprising means to maintain pressure in said jacket below the pressure in said delivery conduit, whereby said jacket maintains liquid cryogen flowing in said delivery conduit at a temperature substantially equal to or below the cryogen's boiling point at atmospheric pressure.

17. The system of claim 16 comprising: (a) a cryogen supply line supplying cryogen to a heat exchanging bath and to said first flow path, said heat-exchanging bath communicating with, and supply cryogen to, said jacket, said bath comprising means to maintain cryogen contained therein at a pressure below the cryogen pressure in said first flow path, whereby cryogen flow in said supply line is split between said bath and said delivery conduit, and said jacket is supplied with cryogen from said bath at a pressure that enables the jacket to sub-cool cryogen in said delivery conduit.

18. The system of claim 1 comprising a jacket surrounding said conduit and means to maintain cryogen pressure in said jacket at a pressure below the pressure in the conduit, said cryogen pressure in said jacket being two inches above atmospheric pressure, or less.

19. Apparatus for delivery of a controlled amount of liquid cryogen to pressurized containers moving along an assembly line toward a capping station, said apparatus comprising;

(a) a source of liquid cryogen at substantially constant pressure, remote from the outlet;

(b) a conduit connecting the source of liquid cryogen to the outlet;

(c) a flow-rate control restriction positioned in the conduit; and (d) means to maintain cryogen substantially entirely in liquid phase as it flows through the conduit, and out of the outlet, and to maintain said flowing cryogen at a temperature substantially equal to or below the cryogen's boiling point at atmospheric pressure;

whereby the cross-sectional area of the restriction controls the rate of liquid cryogen delivered at the outlet, and cryogen is reliably delivered from the outlet substantially as a liquid without severe flashing.

20. The apparatus of claim 29 comprising a velocity-control chamber downstream from the flow-rate control restriction and having a larger cross-sectional area than said flow-rate control restriction, said velocity control chamber being generally horizontal and having a cross-sectional area selected to provide a liquid cryogen stream velocity and direction generally matching the velocity and direction of container movement.

* * * * *